US007908895B2

(12) United States Patent
Kwon et al.

(10) Patent No.: US 7,908,895 B2
(45) **Date of Patent: *Mar. 22, 2011**

(54) LAUNDRY TREATMENT APPARATUS AND CONTROL METHOD THEREOF

(75) Inventors: Ho Cheol Kwon, Chanwon-si (KR); Beom Jun Kim, Kimhae-si (KR); Il Hyeok Yim, Koyang-si (KR); Hack Chai Song, Chanwon-si (KR)

(73) Assignee: LG Electronics Inc., Seoul (KR)

( * ) Notice: Subject to any disclaimer, the term of this patent is extended or adjusted under 35 U.S.C. 154(b) by 1208 days.

This patent is subject to a terminal disclaimer.

(21) Appl. No.: 11/494,797

(22) Filed: Jul. 28, 2006

(65) Prior Publication Data

US 2007/0028398 A1 Feb. 8, 2007

(30) Foreign Application Priority Data

Jul. 30, 2005 (KR) ..... 10-2005-0069991
Jul. 30, 2005 (KR) ..... 10-2005-0069992
Jul. 30, 2005 (KR) ..... 10-2005-0069993

(51) Int. Cl.
*D06F 39/00* (2006.01)

(52) U.S. Cl. ..... 68/17 R

(58) Field of Classification Search ..... 68/17 R
See application file for complete search history.

(56) References Cited

U.S. PATENT DOCUMENTS

2006/0162393 A1* 7/2006 Kwon et al. ..... 68/17 R

FOREIGN PATENT DOCUMENTS

| | | | |
|---|---|---|---|
| GB | 2 223 240 | | 4/1990 |
| GB | 2223240 A | * | 4/1990 |
| JP | 2-136167 | * | 5/1990 |
| JP | 8-144344 | | 6/1996 |
| JP | 408144344 A | * | 6/1996 |

OTHER PUBLICATIONS

Office Action U.S. Appl. No. 11/337,794 dated Mar. 30, 2010 (K-0775).

Office Action U.S. Appl. No. 11/337,794 dated Mar. 9, 2009 (K-0775).

* cited by examiner

*Primary Examiner* — Michael Barr
*Assistant Examiner* — Jason P Riggleman
(74) *Attorney, Agent, or Firm* — KED & Associates, LLP

(57) ABSTRACT

A laundry treatment apparatus is provided that includes a condensing pool disposed within a water supply port formed in a tub, a water supply passage formed between the condensing pool and the water supply port, and a cap that guides water to the condensing pool and stops steam flowing backward through the water supply passage so that the steam is introduced into the condensing pool. The steam flowing backward from an inside of the tub to the water supply port of the tub is brought into contact with the water contained in the condensing pool and is condensed, thereby preventing pollution of a detergent holder or peripheral portions thereof, which may occur when the steam flows backward into the detergent holder or peripheral portions thereof via the water supply port of the tub.

12 Claims, 10 Drawing Sheets

LAUNDRY TREATMENT APPARATUS AND CONTROL METHOD THEREOF

This application claims the benefit of Korean Patent Application No. 10-2005-0069991 filed on Jul. 30, 2005, Korean Patent Application No. 10-2005-0069992 filed on Jul. 30, 2005 and Korean Patent Application No. 10-2005-0069993 filed on Jul. 30, 2005, which is hereby incorporated by reference for all purposes as if fully set forth herein.

BACKGROUND OF THE INVENTION

1. Field of the Invention

The present invention relates, in general, to a laundry treatment apparatus and a control method thereof, and more particularly, to a laundry treatment apparatus and a control method thereof, in which steam flowing backward to a water supply channel of a tub is removed by the water of a condensing pool disposed in the water supply channel of the tub through condensing.

2. Description of the Conventional Art

In general, a laundry treatment apparatus is an apparatus for washing or drying fabrics by rotating the drum with them being contained in the drum. The laundry treatment apparatus may be classified into a washing machine that removes pollutants stained on clothes, bedclothes, etc. (hereinafter, referred to as "fabrics") by employing water, a detergent, a mechanical action, and so on and a combined dry and washing machine that dries wet fabrics.

In the conventional laundry treatment apparatus, water mixed with a detergent or water not mixed with a detergent is supplied into a tub via an inlet bellows connecting an outlet of a detergent holder and a water supply port of the tub. As the drum within the tub is rotated, fabrics contained in the drum are washed and rinsed.

Recently, in order to increase the washing ability of fabrics, there is a tendency that high-temperature washing is performed using water heated by a heater installed within the tub or steam generated from an additional steam-generating device is supplied directly into the drum.

In the conventional laundry treatment apparatus, however, steam within the tub may be drained into the detergent holder via the water supply port of the tub and the inlet bellows, leading to a polluted detergent holder and peripheral portions thereof. There is another problem in that a dewy phenomenon occurs due to steam drained outside the laundry treatment apparatus.

SUMMARY OF THE INVENTION

Accordingly, the present invention has been made in view of the above problems, and it is an object of the present invention to provide a laundry treatment apparatus that can prevent the pollution of a detergent holder, which may occur when steam flows backward, by preventing steam within a tub from flowing backward into a water supply port of the tub.

Another object of the present invention is to provide a method of controlling a laundry treatment apparatus, in which external drainage of steam can be minimized by periodically filling a steam reverse flow-preventing unit with water in preparation for when the water within the steam reverse flow-preventing unit is overflowed.

Further another object of the present invention is to provide a method of controlling a laundry treatment apparatus, in which it can prevent steam from flowing backward during a dry cycle.

To achieve the above objects, a laundry treatment apparatus according to an aspect of the present invention includes a condensing pool disposed within a water supply port formed in a tub. A water supply passage is formed between the condensing pool and the water supply port. The laundry treatment apparatus further includes a cap that guides water, which is supplied to the water supply port, to the condensing pool, and stops steam flowing backward through the water supply passage so that the steam is introduced into the condensing pool.

The condensing pool has an opened top surface so that the supplied water can be overflowed to the water supply passage.

The condensing pool has a circumferential portion isolated from an inner wall of the water supply port in order for a water supply passage to be formed between the circumferential portion and the inner wall of the water supply port.

The laundry treatment apparatus further includes at least one rib connecting a circumferential portion of the condensing pool and an inner wall of the water supply port between the circumferential portion of the condensing pool and the inner wall of the water supply port.

The condensing pool has a bottom surface formed on the same concentric cycle as the tub.

The cap includes a shielding unit disposed on an upper side of the water supply passage, for stopping the rise of the steam, and a hollow water supply unit integrally formed with the shielding unit such that the hollow water supply unit is projected toward the inside of the condensing pool.

The shielding unit has an outer diameter fit into an inner wall of the water supply port so that the shielding unit can be inserted into the water supply port and is mounted therein.

The water supply unit has a tapered diameter.

The water supply unit has a bottom end lower than a top surface of the condensing pool.

The water supply unit has a bottom end having a height isolated from a bottom surface of the condensing pool.

The laundry treatment apparatus further includes a dry device coupled to the tub, for drying a fabric within a drum.

To achieve the above objects, a method of controlling a laundry treatment apparatus according to an aspect of the present invention includes the step of, at the time of hot-water washing of a set temperature or higher, of the laundry treatment apparatus, supplying water to a steam reverse flow-preventing unit disposed on a water supply channel of the laundry treatment apparatus.

The method further includes a water temperature sensing step of sensing a water temperature within a tub, a comparison step of comparing the sensed water temperature with the set temperature, and a condensing water supply step of, if the sensed water temperature is higher than the set temperature, supplying the water to the steam reverse flow-preventing unit disposed on the water supply channel of the laundry treatment apparatus.

The condensing water supply step is repeated at predetermined time intervals.

The condensing water supply step includes opening a water supply valve disposed in the water supply channel for a set time.

The set time is set in proportion to the capacity of a condensing pool of the steam reverse flow-preventing unit.

The water is supplied periodically.

To achieve the above objects, a method of controlling a laundry treatment apparatus according to another aspect of the present invention includes the step of, at the time of a dry cycle of the laundry treatment apparatus, supplying water to a steam reverse flow-preventing unit disposed on a water supply channel of the laundry treatment apparatus.

The method further includes a fabric-amount sensing step of sensing an amount of fabrics at the time of the dry cycle, and a condensing water supply step of operating a dry device, while rotating a drum, so that a fabric is dried after the fabric-amount sensing step and supplying the water to the steam reverse flow-preventing unit installed in the water supply channel.

The condensing water supply step opens a water supply valve disposed in the water supply channel for a set time while the drum is rotated in a one-way direction for the first time.

In the laundry treatment apparatus constructed above according to the present invention, steam flowing backward from the inside of the tub to the water supply port of the tub is brought into contact into with water contained in the condensing pool formed in the water supply port of the tub and is condensed. Accordingly, the present invention is advantageous in that it can prevent the pollution of the detergent holder or peripheral portions thereof, which may occur when steam flows backward into the detergent holder or peripheral portions thereof via the water supply port of the tub.

In the method of controlling the laundry treatment apparatus constructed above according to the present invention, if a water temperature within the tub is higher than a set temperature at which steam is generated within the tub, water is supplied to the steam reverse flow-preventing unit installed on the water supply channel. The water supplied to the steam reverse flow-preventing unit precludes the reverse flow of the steam. Therefore, the present invention is advantageous in that it can minimize the reverse flow of steam and can prevent the contamination of the detergent holder, and the like.

In the method of controlling the laundry treatment apparatus constructed above according to the present invention, if a dry cycle begins, water for condensing steam is supplied to the steam reverse flow-preventing unit installed on the water supply channel. Therefore, the present invention is advantageous in that it can prevent the reverse flow of steam, which has occurred during the dry cycle, although the water of the steam reverse flow-preventing unit is overflowed during a dehydration cycle anterior to the dry cycle.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

The present invention will now be described in detail in connection with specific embodiments with reference to the accompanying drawings.

Figure 1:
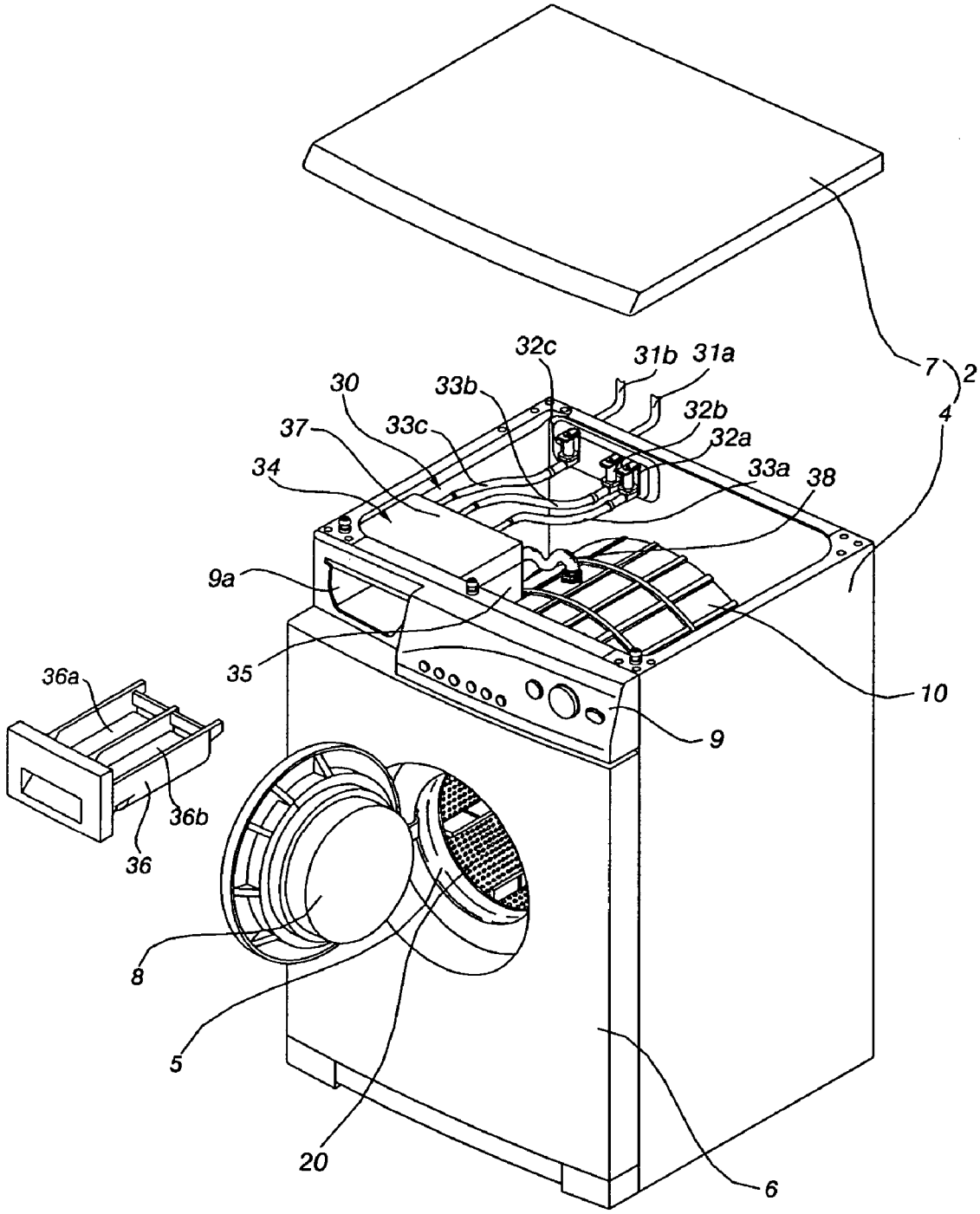
FIG. 1 is a perspective view of a laundry treatment apparatus having an opened top surface according to an embodiment of the present invention.
Figure 2:
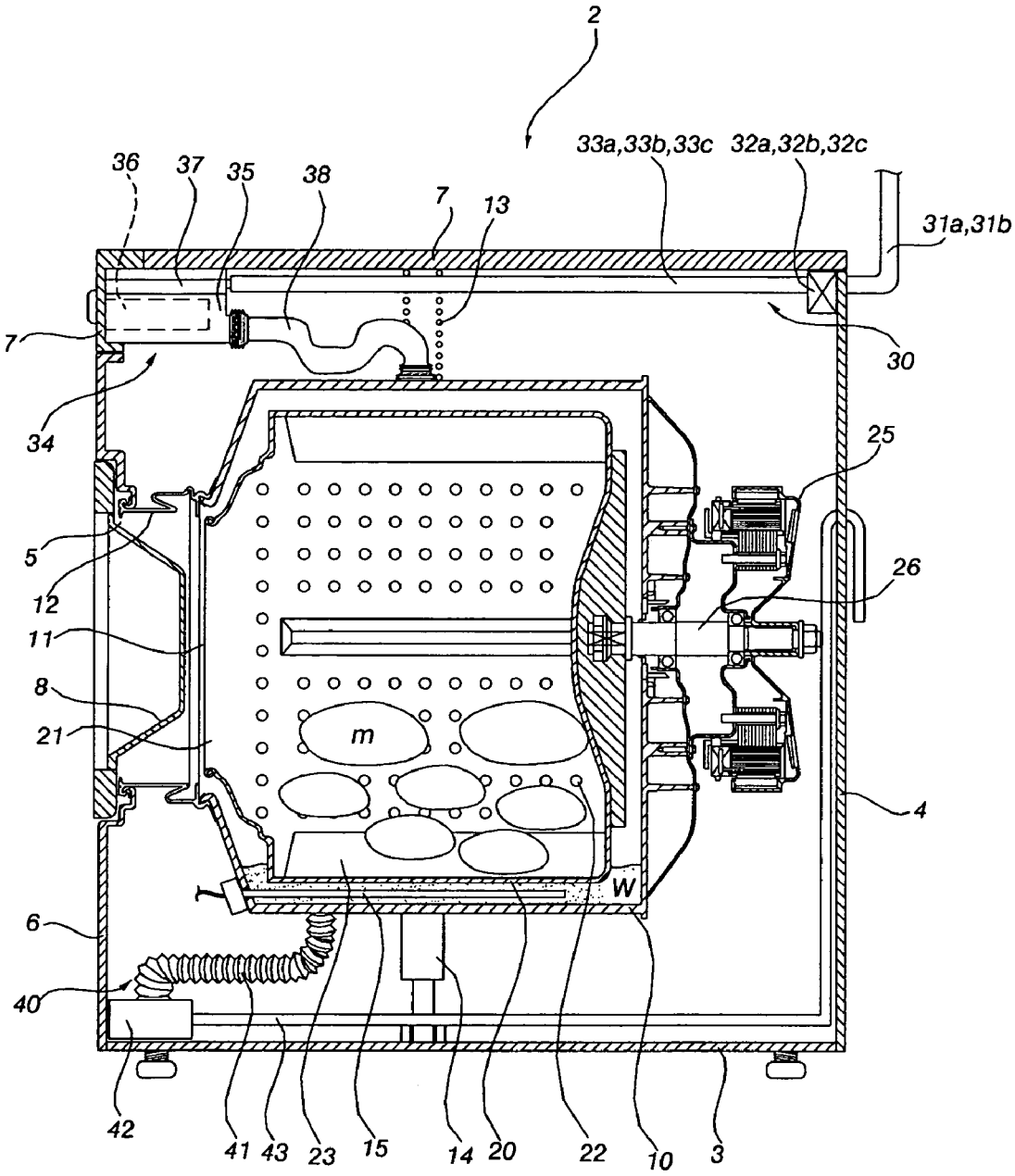
FIG. 2 is a cross-sectional view of the laundry treatment apparatus according to an embodiment of the present invention.

FIG. 1 is a perspective view of a laundry treatment apparatus having an opened top surface according to an embodiment of the present invention, and FIG. 2 is a cross-sectional view of the laundry treatment apparatus according to an embodiment of the present invention.

Referring to FIGS. 1 and 2, the laundry treatment apparatus includes a cabinet 2, a tub 10 supported within the cabinet 2 in a shock-absorbing manner, for containing water W, a drum 20 rotatably disposed within the tub 10, for containing fabric m, driving means 25 for rotating the drum 20 so that the fabric m is washed, rinsed, and dehydrated, a water supply device 30 for supplying the water W to the tub 10, and a discharge device 40 for forcibly discharging polluted water W within the tub 10 or water dehydrated from the fabric m outside the cabinet 2.

The cabinet 2 includes a base 3, a cabinet main body 4 disposed on the base 3, a cabinet cover 6 disposed at the front of the cabinet main body 4 and having a fabric inlet hole 5 through which the fabric m can go in and out, and a top cover 7 disposed on a top surface of the cabinet main body 4.

A door 8 for opening and closing the fabric inlet hole 5 is rotatably disposed in the cabinet cover 6.

A control panel 9 for inputting washing/rinse/dehydration, high-temperature/steam washing, and/or so on is disposed on one side of the cabinet 2.

A detergent holder inlet 9*a* for containing a detergent holder 36 is formed in the control panel 9.

A water supply port (not shown) to which the water supply device 30 is connected on the upper side of the tub 10 is projected from the tub 10.

A discharge port (not shown) to which the discharge device 40 is connected on the lower side of the tub 10 is projected from the tub 10.

The tub 10 has a tub-opening unit 11 formed on the rear side of the fabric inlet hole 5.

To the tub-opening unit 11 is coupled a gasket 12 for preventing the water W or the fabric m from flowing between the tub-opening unit 11 and the fabric inlet hole 5.

The tub 10 is resiliently supported to the cabinet 2 by means of a spring 13 or a damper 14.

A heater 15 for heating the water W supplied to the tub 10 in order to wash the fabric m at high temperature is disposed in the tub 10.

The heater 15 heats the water W to any one of 40° C., 50° C., 60° C., 70° C., and 90° C. if high-temperature/steam washing is input through the control panel 9.

The drum 20 includes a fabric inlet hole 21 through which fabrics enter the drum 20, which is disposed at the rear of the fabric inlet hole 5 of the cabinet cover 6.

In the drum 20 is formed a through-hole 22 through which the water W can go in and out.

In the drum 20 is disposed a lifter 23 for drawing the fabric m upwardly when the drum 20 is rotated and then dropping the fabric m.

The driving means 25 is a motor mounted on the rear surface of the tub 20. The driving means includes a drive shaft 26 coupled to the back of the drum 20 via the through-hole formed on the rear side of the tub 10.

The water supply device 30 includes water supply valves 32*a*, 32*b*, and 32*c* coupled to external hoses 31*a* and 31*b*, for controlling the water supplied to the external hoses 31*a* and 31*b*, water supply hoses 33*a*, 33*b*, and 33*c* for guiding the water that has passed the water supply valves 32*a*, 32*b*, and 32*c*, a detergent supply unit 34 having formed a detergent reception unit and a water supply passage therein so that the water guided to the water supply hoses 33*a*, 33*b*, and 33*c* can be mixed with a detergent while passing, and a water supply bellows tube 38 for guiding the water that has passed the detergent supply unit 34 to the water supply port of the tub 10.

The water supply valves 32*a*, 32*b*, and 32*c* include a plurality of cold-water supply valves 32*a* and 32*b*, one hot-water supply valve 32*c*, and so on.

The water supply hoses 33*a*, 33*b*, and 33*c* include a plurality of cold-water supply hoses 33*a* and 33*b* for guiding the water that has passed the cold-water supply valves 32*a* and 32*b* to the detergent supply unit 34, and a hot-water supply hose 33*c* for guiding the water that has passed the hot-water supply valve 32*c* to the detergent supply unit 34.

The detergent supply unit 34 includes a detergent holder housing 35 to which the water supply bellows 38 is coupled, the detergent holder 36 detachably disposed in the detergent holder housing 35, and a dispenser cover 37 disposed on a top surface of the detergent holder housing 35, for supplying water to the detergent holder 36. The dispenser cover 37 is coupled to the plurality of water supply hoses 33*a*, 33*b*, and 33*c*.

In the detergent holder 36 are formed detergent reception units 36*a* and 36*b* for containing a detergent.

The discharge device 40 includes a drainage bellows 41 coupled to the discharge port of the tub 10, for guiding the water within the tub 10, a drainage pump 42 for pumping the water guided to the drainage bellows 41, and a drainage hose 43 for guiding the water pumped from the drainage pump 42 outside the cabinet 2.

Meanwhile, the laundry treatment apparatus further includes a steam reverse flow-preventing unit for preventing steam within the tub 10 from flowing backward to the detergent holder 36 via the water supply port of the tub 10, the water supply bellows rube 38, and so on.

The steam reverse flow-preventing unit is a kind of a condenser for condensing reverse-flown steam onto the water W and removing the steam. The steam reverse flow-preventing unit may be disposed within at least one of the tub 10, the water supply port of the tub 10, the water supply bellows the 38, and the detergent holder 36.

If the steam reverse flow-preventing unit is disposed within the tub 10, there is a high possibility that it may collide against the drum 20. If the steam reverse flow-preventing unit is disposed within the water supply bellows tube 38, it is difficult to install the steam reverse flow-preventing unit and also to preserve the water W. If the steam reverse flow-preventing unit is disposed within the detergent holder 36, the structure of the detergent holder 36 becomes complicated and the detergent holder 36 becomes bulky. Therefore, it is most preferred that the steam reverse flow-preventing unit is disposed within the water supply port of the tub 10.

Figure 3:
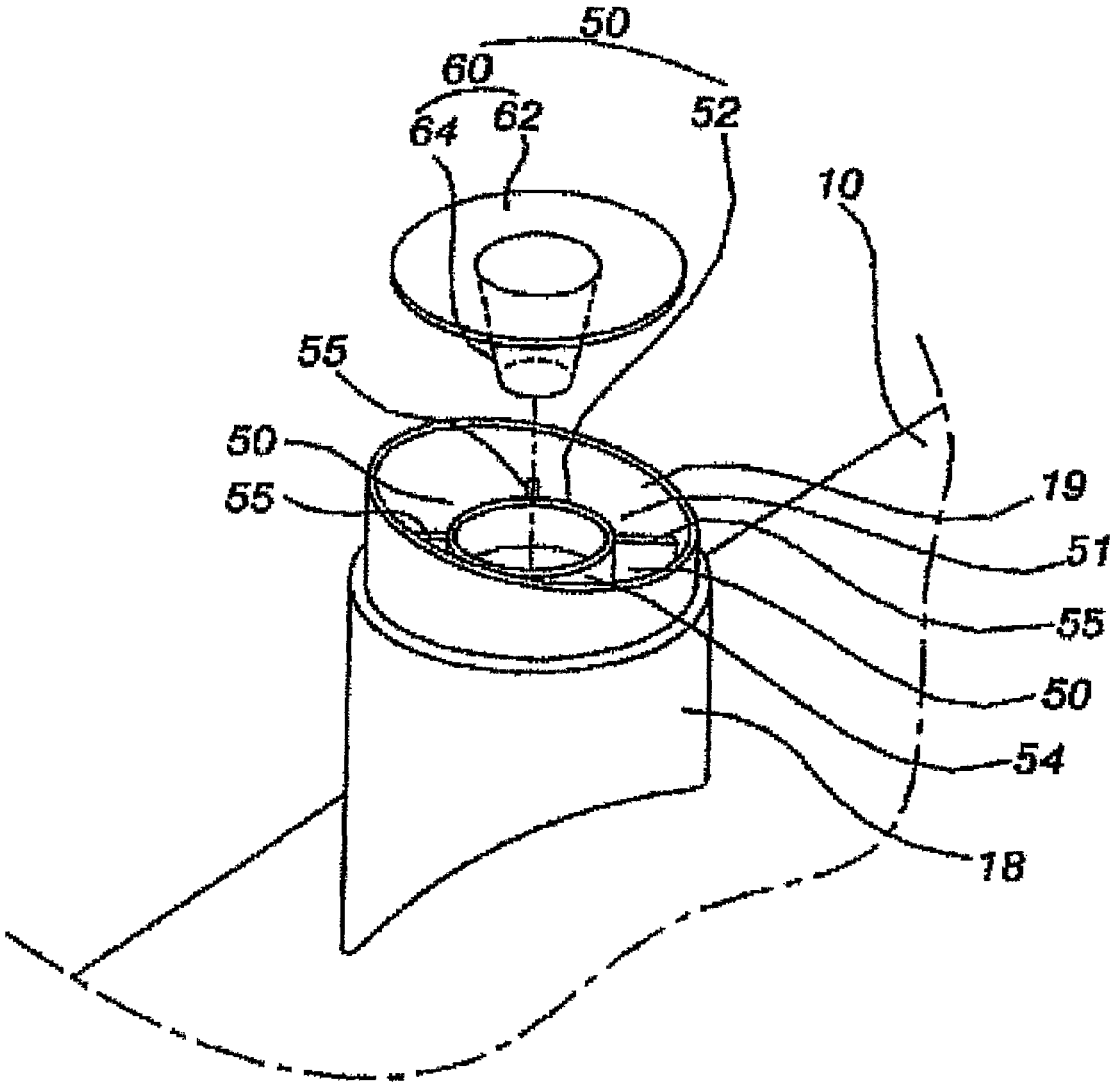
FIG. 3 is an exploded perspective of the steam reverse flow-preventing unit of the laundry treatment apparatus according to the present invention.
Figure 4:
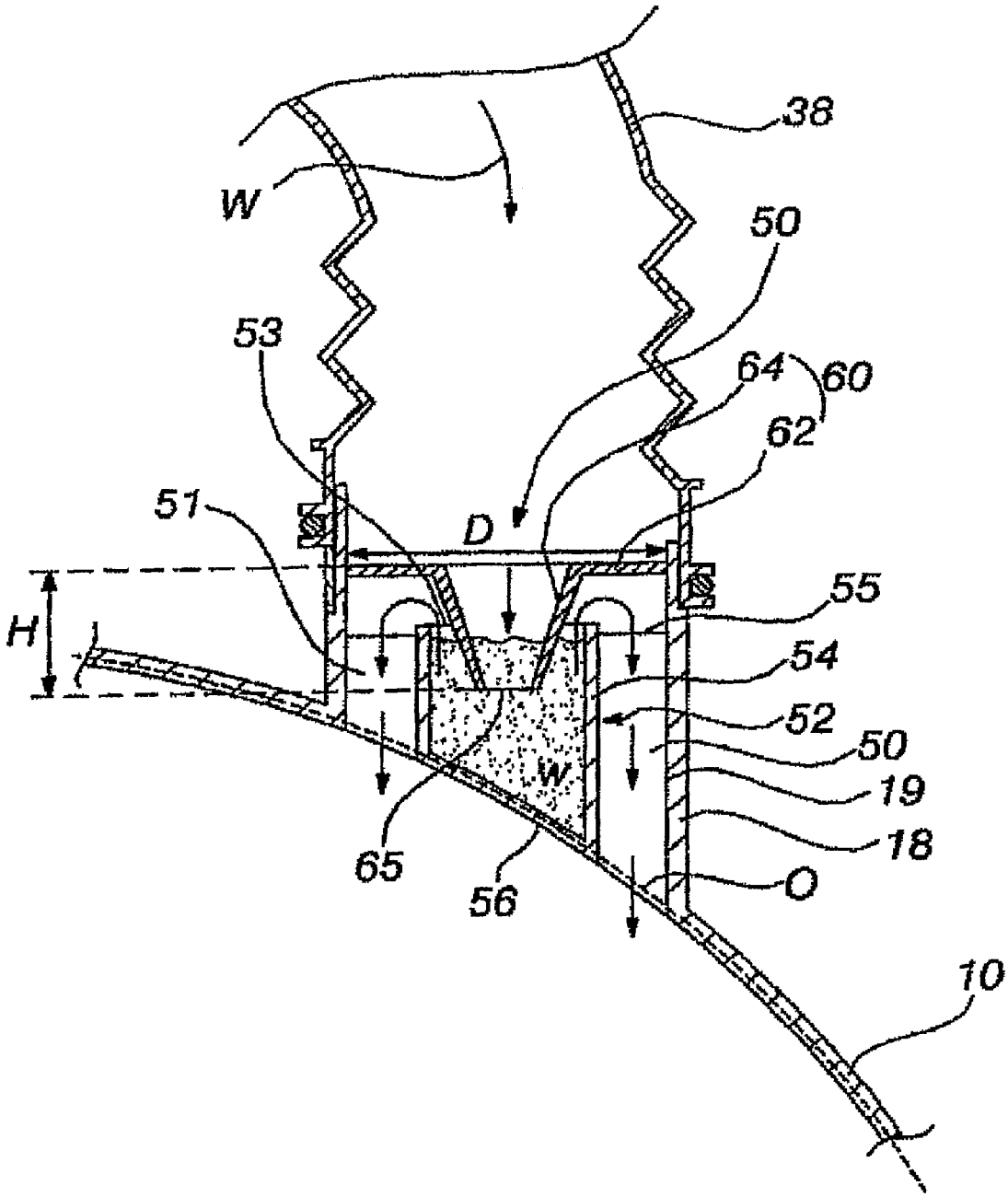
FIG. 4 is an enlarged cross-sectional view when water is feed to a water supply channel in the laundry treatment apparatus according to an embodiment of the present invention.
Figure 5:
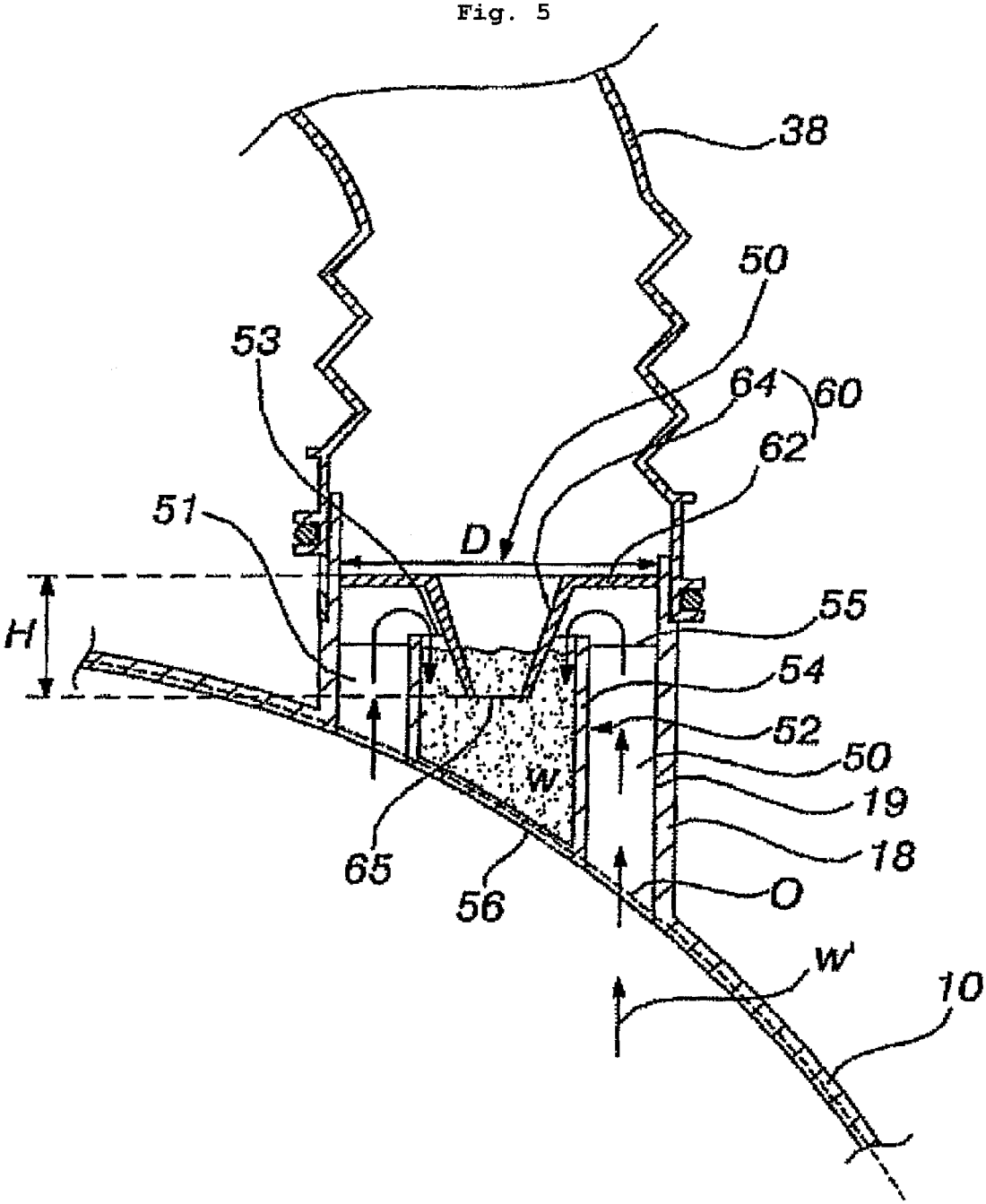
FIG. 5 is an enlarged cross-sectional view when steam is reverse flowed to the water supply channel in the laundry treatment apparatus according to an embodiment of the present invention.

FIG. 3 is an exploded perspective of the steam reverse flow-preventing unit of the laundry treatment apparatus according to the present invention, FIG. 4 is an enlarged cross-sectional view when water is fed to a water supply channel in the laundry treatment apparatus according to an embodiment of the present invention, and FIG. 5 is an enlarged cross-sectional view when steam is reverse flowed to the water supply channel in the laundry treatment apparatus according to an embodiment of the present invention.

Referring to FIGS. 3 to 5, a steam reverse flow-preventing unit 50 includes a condensing pool 52 disposed within a water supply port 18 of the tub 10 so that a water supply passage 51 is formed between the condensing pool 52 and the water supply port 18, and a cap 60 that guides the water W supplied to the water supply port 18 to the condensing pool 52 and stopping steam W' flowing backward through the water supply passage 51 so that the steam is introduced into the condensing pool 52.

A top surface 53 of the condensing pool 52 is opened so that the supplied water W can overflow a circumferential portion 54.

The circumferential portion 54 of the condensing pool 52 is isolated from an inner wall 19 of the water supply port 18 in order for the water supply passage 51 to be formed between the circumferential portion 54 and the inner wall 19.

That is, the water supply channel of the water W has a zigzag shape in which a ∪-shaped passage and a ∩-shaped passage are continuous.

At least one rib 55 for connecting the circumferential portion 54 of the condensing pool 52 and the inner wall 19 of the water supply port 18 is formed between the circumferential portion 54 of the condensing pool 52 and the inner wall 19 of the water supply port 18.

The rib 55 extends up and down lengthily and has a thin thickness.

A plurality of the ribs 55, which are isolated from each other, may be formed in the circumferential direction of the water supply port 18.

If a portion of the condensing pool 52 is projected downwardly from the inner wall of the tub 10, there is a high possibility that it may collide against the drum 20. Accordingly, it is preferred that the condensing pool 52 is formed as large as possible in consideration of rapid supply of water. It is also preferred that a bottom surface 56 of the condensing pool 52 is formed on the same concentric cycle O as the tub 10.

The condensing pool 52 and the rib 55 are integrally formed with the water supply port 18 at the time of injection molding of the tub 10.

The cap 60 is located on the upper side of the water supply passage 51. The cap 60 includes a shielding unit 62 that prevents the steam W' from rising upwardly from the water supply passage 51, and a hollow water supply unit 64 integrally formed with the shielding unit 62 and projecting toward the inside of the condensing pool 52.

The shielding unit 62 has an outer diameter D fit into the inner well 19 of the water supply port 18 so that it can be inserted into the water supply port 18 and seated therein.

The water supply unit 64 has a tapered diameter.

The water supply unit 64 has a bottom end 65 lower than the top surface 53 of the condensing pool 52, but has a height H isolated from the bottom surface 56 of the condensing pool 52.

The operation of the laundry treatment apparatus constructed above according to an embodiment of the present invention will be described below.

At the time of a water supply process for washing or a water supply process for rinse, the water W that has passed the detergent holder 36 is supplied to the water supply port 18 of the tub 10 via the water supply bellows 38. The water W is then stopped by the top surface of the shielding unit 62 of the cap 60 and does not drop to the water supply passage 51, but is guided to the top surface of the shielding unit 62 and then drops to the water supply unit 64 of the cap 60.

The water W dropped to the water supply unit 64 is supplied to the condensing pool 52. If the water W within the condensing pool 52 is full to the brim of the condensing pool 52, it is overflowed to the water supply passage 51 between the circumferential portion 54 of the condensing pool 52 and the inner wall 19 of the water supply port 18 of the tub 10. Thereafter, the water W drops to the tub 10 through the water supply passage 51 and is contained within the tub 10.

Meanwhile, in the laundry treatment apparatus, at the time of high-temperature/steam washing carried out subsequently to the above-mentioned water supply, a portion of the steam W' within the tub 10 may rise and be introduced into the water supply port 18 of the tub 10. Therefore, the steam W' rises along the water supply passage 51.

The risen steam W' is stopped by the shielding unit 62 of the cap 60, no longer rises, and is thus directed toward the condensing pool 52. Accordingly, at the time of the water supply, the raised steam W' is brought in contact with the water W left without being overflowed from the condensing pool 52 and is condensed. The water W left in the condensing pool 52 and condensed water in which the steam W' is condensed are mixed and remain in the condensing pool 52.

Meanwhile, the water level of the condensing pool 52 is raised by the condensed water. A part of the mixed solution of the water and the condensed water is overflowed to the water supply passage 51 during the water supply process for washing or the water supply process for rinse and drops to the tub 10.

In other words, the steam W' is not flown backward to the upper side of the water supply port 18 of the tub 10.

Figure 6:
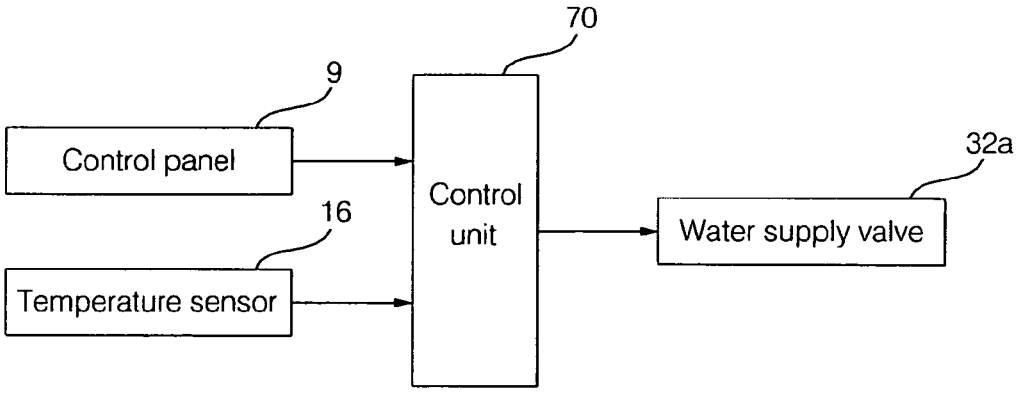
FIG. 6 is a control block diagram illustrating a method of controlling the laundry treatment apparatus according to an embodiment of the present invention.

FIG. 6 is a control block diagram of the laundry treatment apparatus according to the present invention.

The laundry treatment apparatus of the present invention further includes a temperature sensor 16 that senses a temperature of the water W, and a control unit 70 that controls the water supply valves 32*a* and 32*b* according to the input of the control panel 9 or a temperature value of the water W, which is sensed by the temperature sensor 16.

The control unit 70 controls the water supply valves 32*a* and 32*b* to periodically supply condensing water to the steam reverse flow-preventing unit 50 in preparation for when the water W is overflowed within the steam reverse flow-preventing unit 50 due to vibration of the tub 10, and so on at the time of hot-water washing of a set temperature or higher (for example, 50° C. or more).

The hot-water washing may be typical hot-water washing in which washing is performed by hot water supplied through the hot-water valve 32*c*, high-temperature washing in which washing is performed by hot water within the tub 10, which is heated by the heater 15, or steam washing in which washing is carried out by high-temperature steam, which is generated from a steam generating device (not shown) provided separately from the water supply device 30 and is sprayed into the drum via the hoses, nozzles, and the like.

Hereinafter, it is assumed that high-temperature washing employing the heater 15 is the hot-water washing for the convenience of description.

Furthermore, the control unit 70 may control the water supply valves 32*a* and 32*b* to periodically supply condensing water to the steam reverse flow-preventing unit 50 regardless of whether steam exists within the tub 10 at the time of the input of the above-mentioned hot-water washing, and also control the water supply valves 32*a* and 32*b* to periodically supply condensing water to the steam reverse flow-preventing unit 50 only when steam is generated within the tub 10. In the present embodiment, it is assumed that condensing water is periodically supplied only when steam is generated within the tub 10.

The control unit 70 can turn on/off both the water supply valves 32*a* and 32*b* periodically. Hereinafter, it is assumed that the control unit 70 turns on/off only the water supply valve 32*a* at a predetermined cycle.

Figure 7:
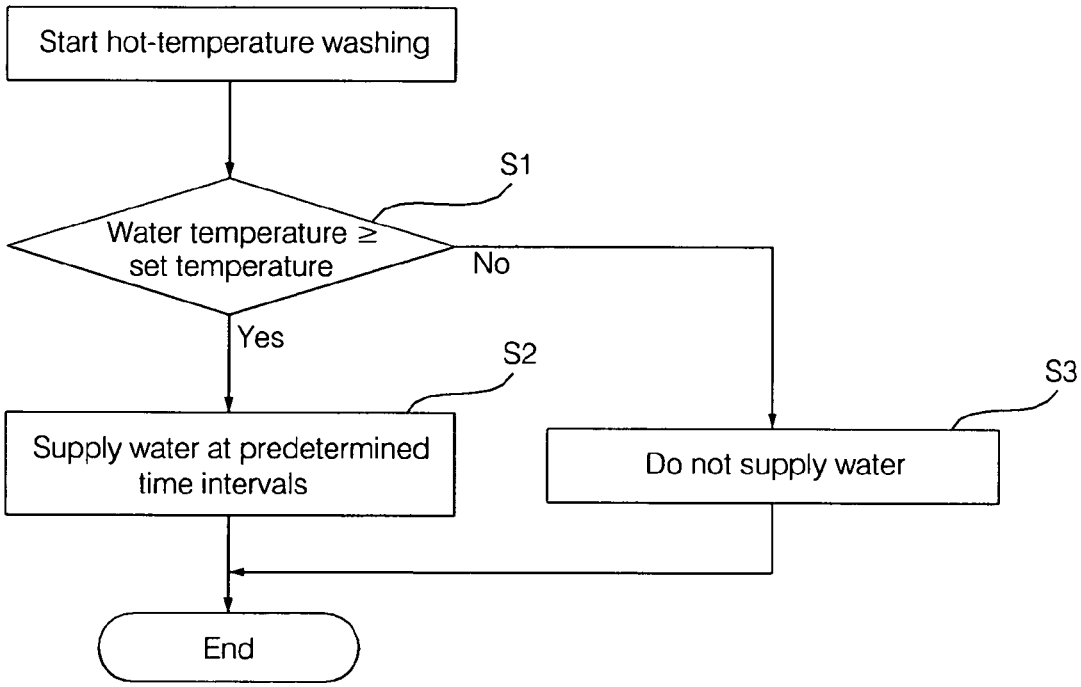
FIG. 7 is a flowchart illustrating a method of controlling the laundry treatment apparatus according to an embodiment of the present invention.

FIG. 7 is a flowchart illustrating a method of controlling the laundry treatment apparatus according to an embodiment of the present invention.

In the method of controlling the laundry treatment apparatus according to the present embodiment, at the time of the hot-water washing in which the heater 15 heats the water W within the tub 10, the temperature sensor 16 senses a temperature of the water W supplied to the tub 10 and transmits a sensed temperature to the control unit 70.

The control unit 70 compares the temperature sensed by the temperature sensor 16 with a set temperature in step S1.

The set temperature is an approximate temperature of the water at which steam is generated within the tub 10. Hereinafter, it is assumed that the set temperature is 50° C.

If it is determined that the sensed temperature of the water W is higher than 50° C., the control unit 70 determines that the steam W' has been generated within the tub 10. Accordingly, the control unit 70 periodically turns on/off the water supply valve 32*a* at predetermine intervals in order to fill the steam-generating device (more particularly, the condensing pool 52) with water in step S2.

The turn-on/off of the water supply valve 32*a* at predetermined time intervals and an operation accordingly will be described in more detail below.

The control unit 70 turns on the water supply valve 32*a* for a set time (for example, 5 seconds) at predetermined time (for example, 10 minutes) intervals and then turns off the water supply valve 32*a*.

The predetermined time may be set in proportion to the degree in which water is overflowed from the condensing pool 52 due to vibration of the tub 10, etc. It is preferred that when the overflow of water is frequent (for example, the vibration of the tub is great), the predetermined time is set short and when the overflow of water is not frequent (for example, the vibration of the tub is small), the predetermined time is set long.

It is preferred that the predetermined time is set in proportion to the number of vibration of the tub 10 or the number of rotation of the drum 20.

Furthermore, the set time may be set in proportion to the capacity of the condensing pool 52. When the capacity of the condensing pool 52 is small, the set time is set so that a small amount of water is supplied. When the capacity of the condensing pool 52 is great, the set time is set so that a great amount of water is supplied.

Meanwhile, in the laundry treatment apparatus of the present invention, when the water supply valve 32*a* is turned on, the water of the external hose 31*a* is supplied to the water supply hose 33*a* via the water supply valve 32*a*. Thereafter, the water sequentially passes the detergent supply unit 34 and the water supply bellows 38 and is then guided to the water supply port 18 of the tub 10.

The water guided to the water supply port 18 of the tub 10 is guided to the top surface of the shielding unit 62 of the cap 60 and is dropped to the water supply unit 64 of the cap 60. The water then fills the condensing pool 52.

A portion of the steam W' generated from the inside of the tub 10 rises along the water supply passage 50 and is then stopped by the shielding unit 62 of the cap 60. The risen steam W' is brought in contact with the water W filled in the condensing pool 52 and is condensed accordingly, so that the steam does not flow backward to the upper side of the water supply port 18 of the tub 10.

On the other hand, if the sensed temperature is less than the set temperature in step S1, the control unit 70 determines that steam has not been generated within the tub 10 or an amount of steam generated is very small. Accordingly, the control unit 70 does not repeat the turn-on/off the water supply valve 32*a* in step S3.

Figure 8:
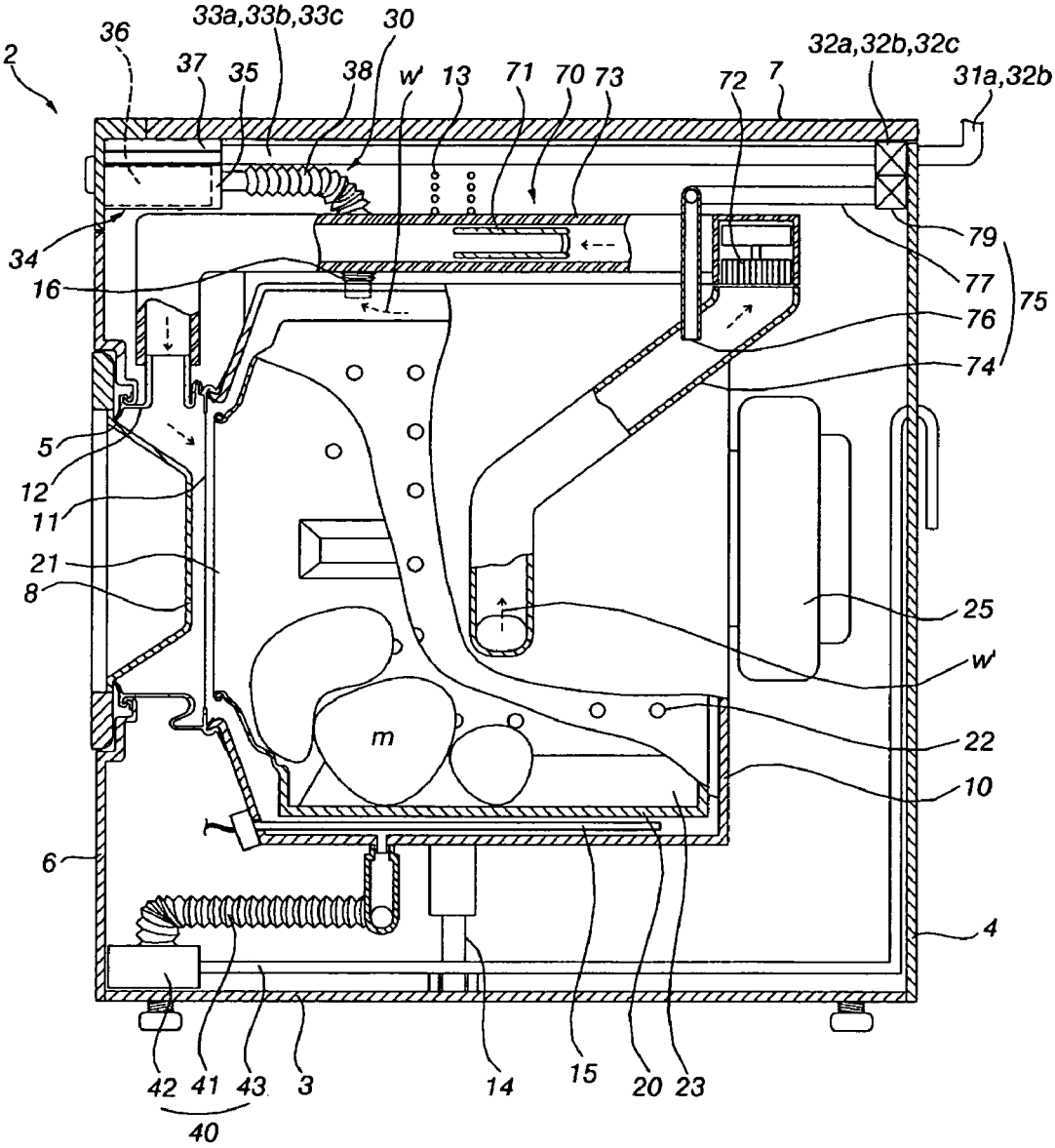
FIG. 8 is a partially cutaway sectional view of a laundry treatment apparatus according to another embodiment of the present invention.
Figure 9:
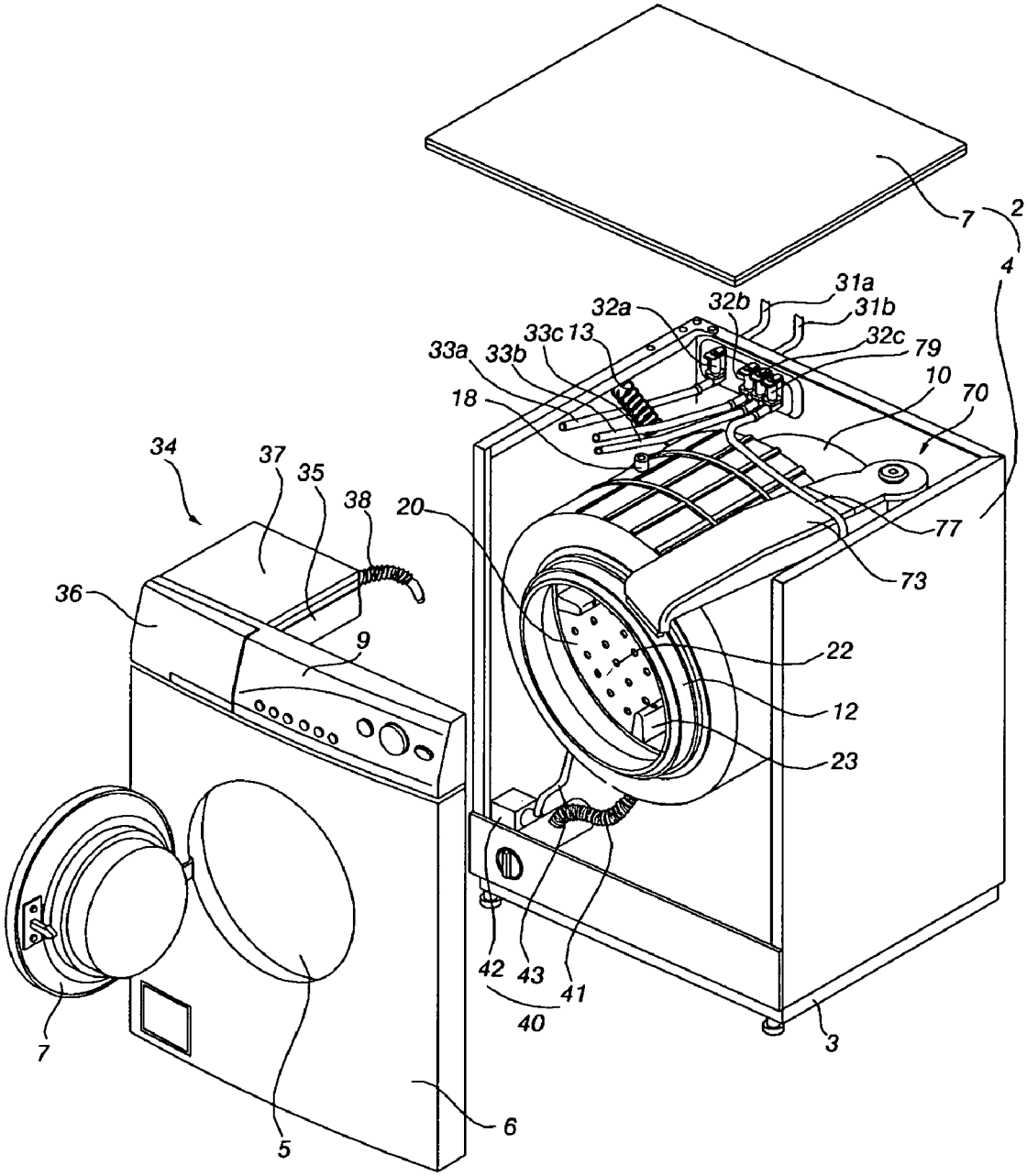
FIG. 9 is a partially exploded perspective view of the laundry treatment apparatus according to another embodiment of the present invention.
Figure 10:
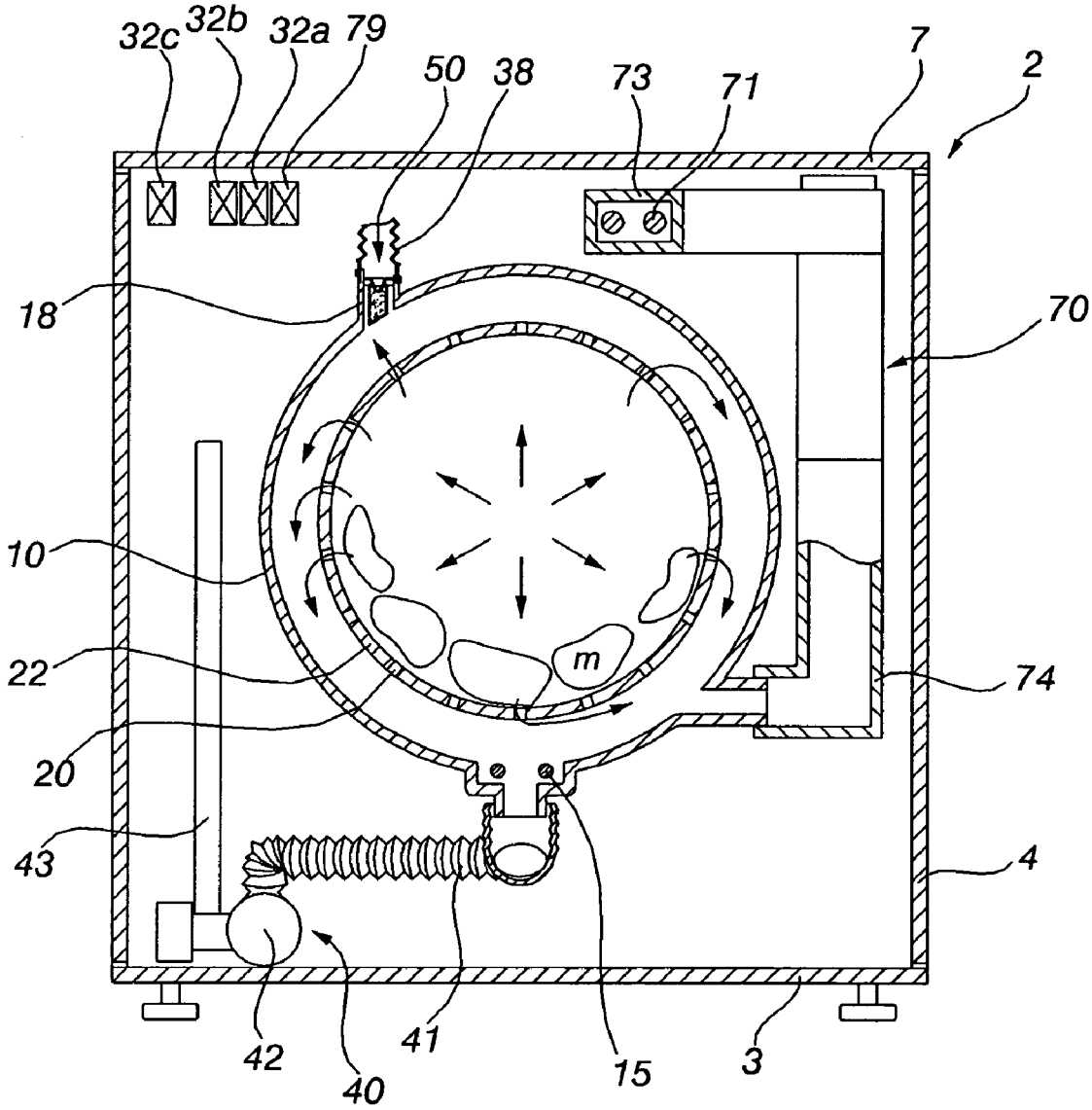
FIG. 10 is a cross-sectional view of the laundry treatment apparatus according to another embodiment of the present invention.

FIG. 8 is a partially cutaway sectional view of a laundry treatment apparatus according to another embodiment of the present invention, FIG. 9 is a partially exploded perspective view of the laundry treatment apparatus according to another embodiment of the present invention, and FIG. 10 is a cross-sectional view of the laundry treatment apparatus according to another embodiment of the present invention.

The laundry treatment apparatus according to the present embodiment includes a dry device 70 for drying a fabric m within a drum 20, as shown in FIGS. 8 to 10. The laundry treatment apparatus of the present embodiment has the same or similar construction and function as those of the laundry treatment apparatus according to an embodiment of the present invention except for the dry device 70. Therefore, the laundry treatment apparatus of the present embodiment will use the same reference numerals as those of the laundry treatment apparatus according to an embodiment of the present invention and will not be described in detail for simplicity.

The dry device 70 includes a dry duct 73 having built a heater 71 and a circulation fan 72 therein, for supplying hot wind to the inside of the drum 20, a condensing duct 74 through which air within the tub 10 passes, and a coolant feeder 75 for supplying a condensing coolant to the inside of the condensing duct 74.

The condensing duct 74 has one end coupled to the tub 10.

The dry duct 73 has one end coupled to the other end of the condensing duct 74 and the other end coupled directly to the gasket 12 or the tub 10.

The coolant feeder 75 includes a water supply nozzle 76 formed on one side of the condensing duct 74, for causing the coolant to flow into the condensing duct 74 so that moisture in the air passing through the condensing duct 74 is condensed, a coolant hose 77 that guides the coolant to the water supply nozzle 76, and a coolant valve 79 that stops the coolant supplied to the coolant hose 77.

Meanwhile, the laundry treatment apparatus of the present embodiment includes the same steam reverse flow-preventing unit as that according to an embodiment of the present invention in the water supply port 18 of the tub 10.

Figure 11:
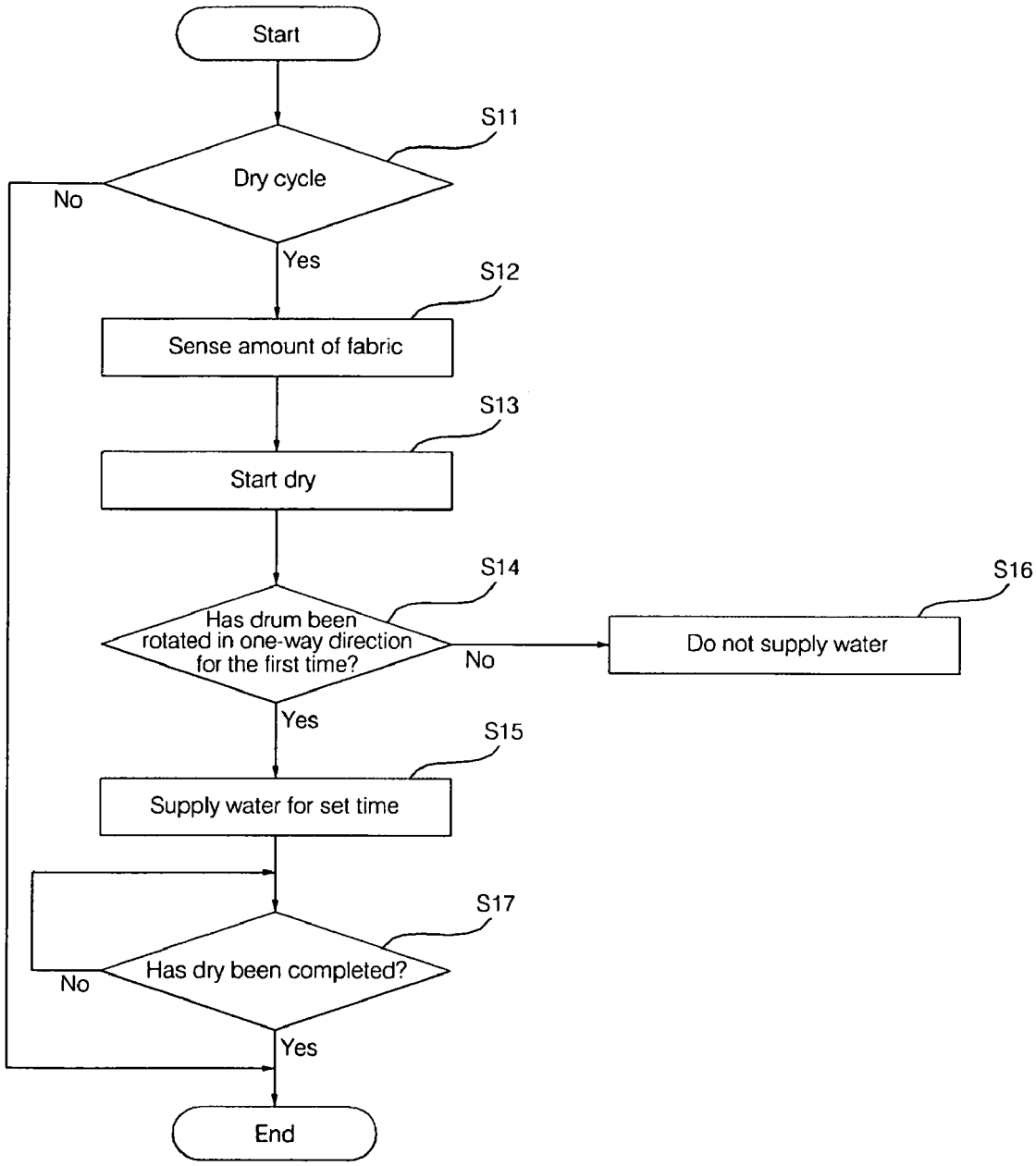
FIG. 11 is a flowchart illustrating a method of controlling the laundry treatment apparatus according to another embodiment of the present invention.

FIG. 11 is a flowchart illustrating a method of controlling the laundry treatment apparatus according to another embodiment of the present invention.

The method of controlling the laundry treatment apparatus according to the present embodiment can be applied to not only a case where a dry cycle is performed after a washing cycle, a rinse cycle, and a dehydration cycle are preformed, but also a case where only the dry cycle is performed. An example in which the dry cycle is performed after the washing cycle, the rinse cycle, and the dehydration cycle are implemented will be described below.

In the method of controlling the laundry treatment apparatus according to the present embodiment, at the time of the dehydration cycle anterior to the dry cycle, water is supplied to the steam reverse flow-preventing unit 50 at the time of the dry cycle in preparation for when the water of the steam reverse flow-preventing unit 50 (more particularly, the condensing pool 52) is overflowed.

Furthermore, in the laundry treatment apparatus, the water W is supplied to the steam reverse flow-preventing unit 50 after an amount of fabrics is sensed because the water supplied while sensing the amount of the fabrics, which is performed at the initial stage of the dry cycle, can be overflowed.

That is, the laundry treatment apparatus first senses the amount of the fabrics if the dry cycle has been input in steps S11 and S12.

At this time, the amount of the fabrics can be sensed using a time, which is taken for the drum 36 to rotate once from the start-up of the motor 15. If the motor 15 reaches a set RPM after the start-up, the motor is kept to a constant velocity for a set time and is then turned off. It is possible to sense the amount of the fabrics by adding a value in which an average value of a pulse width modulation (PWM) duty value from when the motor starts up to when the motor is kept to the constant velocity and a PWM duty value obtained by measuring a marginal rotary angle since the motor 30 is turned off is multiplied by a proportional constant, and a value in which a rotary angle by marginal force is multiplied by a proportional constant.

The laundry treatment apparatus decides a subsequent dry time, etc. based on the sensed amount of the fabrics and controls the motor 15, the heater 41, the circulation fan 42, and the coolant valve 48 to begin the dry cycle in step S13.

The laundry treatment apparatus opens the water supply valve 32*a* for a set time (for example, 20 to 30 seconds) so that the water can be supplied to the condensing pool 52 when the motor 15 rotates the drum 36 in a one-way direction (for example, at the time of the first left rotation of alternating left and right rotations) for the first time after the amount of the fabrics is sensed (step S12) in steps S14 and S15.

The laundry treatment apparatus does not open the water supply valve 32*a* until the motor 15 rotates the drum 36 in a one-way direction for the first time and waits in steps S14 and S16.

The set time may be set in proportion to the capacity of the condensing pool 52. When the capacity of the condensing pool 52 is small, the set time is set so that a small amount of the water W is supplied. When the capacity of the condensing pool 52 is great, the set time is set so that a relatively great amount of the water W is supplied.

The opening of the water supply valve 32*a* may be performed after the dry process is performed for a long time or may be performed at the initial stage of the dry process as described above. It is preferred that the opening of the water supply valve 32*a* is performed when the drum 20 is rotated in a one-way direction for the first time, as described above, in order to efficiently preclude steam generated at the early stage of the dry process.

In the laundry treatment apparatus of the present embodiment, when the water supply valve 32*a* is turned on, the water W of the external hose 31*a* is supplied to the water supply hose 33*a* via the water supply valve 32*a*. The water W is then guided to the inside of the water supply port 18 of the tub 10 sequentially through the dispenser 37, the detergent holder 36, the detergent holder housing 35, and the water supply bellows 38.

The water W guided to the water supply port 18 of the tub 10 is guided to the top surface of the shielding unit 62 of the cap 60 and is dropped to the water supply unit 64 of the cap 60. The water W fills the condensing pool 52.

Meanwhile, in the laundry treatment apparatus, the steam W' is generated within the tub 10 by controlling the heater 71 and the circulation fan 72. A portion of the steam W' rises along the water supply passage 51.

The risen steam W' is stopped by the shielding unit 62 of the cap 60. The risen steam W' is then brought in contact with the water W filled in the condensing pool 52 and is condensed accordingly, so that the steam W' does not flow backward to the upper side of the water supply port 18 of the tub 10.

In the laundry treatment apparatus, dry according to an amount of fabrics is performed with the reverse flow of the steam W' being stopped as described above. If the dry process is completed, a cold-wind dry process in which only the motor 25 and the circulation fan 42 are controlled is performed and the whole dry process is finished in step S17.

Meanwhile, the present invention is not limited to the above-mentioned embodiments, but may be applied to hot-water washing in which washing is performed by hot water supplied through the hot-water valve 32*c* and steam washing in which washing is carried out by high-temperature steam, which is generated from a steam generating device, while spraying the steam toward the inside of the drum through the hoses, nozzles, and the like. The present invention may also be applied to a case where the steam reverse flow-preventing unit 50 is disposed within the water supply bellows 38 or the detergent holder 36. It will be evident to those having ordinary skill in the art that the present invention can be implemented in various ways within the scope of the present invention.

The laundry treatment apparatus constructed above according to an embodiment of the present invention has the following advantages.

In accordance with the laundry treatment apparatus according to the present invention, steam flowing backward from the inside of the tub to the water supply port of the tub is brought into contact into with water contained in the condensing pool formed in the water supply port of the tub and is condensed. Therefore, the present invention is advantageous in that it can prevent the pollution of the detergent holder or peripheral portions thereof, which may occur when steam flows backward into the detergent holder or peripheral portions thereof via the water supply port of the tub.

Furthermore, in the laundry treatment apparatus of the present invention, the condensing pool is formed within the water supply port of the tub. Therefore, the present invention is advantageous in that the structure is simple compared with when the condensing pool is formed in the tub, the water supply bellows or the detergent holder and damage to the water supply bellows, the detergent holder or the like due to high-temperature steam can be prevented.

Furthermore, in the laundry treatment apparatus of the present invention, the cap mounted in the water supply port of the tub guides water supplied to the water supply passage of the tub to the condensing pool and also guides steam flowing backward through the water supply passage to the condensing pool. Accordingly, the water supply channel of the water is identical to the reverse flow passage of the steam. Therefore, the present invention is advantageous in that an additional water supply channel for containing water in the condensing pool is unnecessary and the structure is simple.

Furthermore, in the laundry treatment apparatus of the present invention, the top surface of the condensing pool is opened, and the circumferential portion is isolated from the inner wall of the water supply port. Accordingly, the water supply channel of the water has a zigzag shape in which the ∪-shaped passage and the ∩-shaped passage are continuous. Therefore, the present invention is advantageous in that it can supply water to the tub easily while leaving a predetermined amount of water in the condensing pool.

Furthermore, in the laundry treatment apparatus of the present invention, at least one rib is formed between the circumferential portion of the condensing pool and the inner wall of the water supply port. Therefore, the present invention is advantageous in that the condensing pool can be integrally formed within the water supply port and the water supply channel of water overflowing from the condensing pool can be secured.

Furthermore, in the laundry treatment apparatus of the present invention, the bottom surface of the condensing pool is formed on the same concentric cycle as the tub. Therefore, not only the collision of the condensing pool and the drum can be prevented, but also an internal capacity of the condensing pool can be maximized. Accordingly, the present invention is advantageous in that it can prevent the reverse flow of a portion of steam, which may occur when an amount of water within the condensing pool is small.

Furthermore, the laundry treatment apparatus of the present invention includes the shielding unit having the cap disposed on the upper side of the water supply passage, for preventing the rise of steam, and the hollow water supply unit integrally formed with the shielding unit and projecting toward the inside of the condensing pool. Therefore, the present invention is advantageous in that it can supply water and can also preclude steam using a simple structure.

Furthermore, in the laundry treatment apparatus of the present invention, the shielding unit has an outer diameter fit into the inner wall of the water supply port. Therefore, the present invention is advantageous in that it can prevent steam from leaking between the cap and the water supply port.

Furthermore, in the laundry treatment apparatus of the present invention, the water supply unit has a tapered diameter and the space between the water supply unit and the outer wall unit of the condensing pool is sufficiently wide. Therefore, the present invention is advantageous in that water can be overflowed widely over the whole top surface of the condensing pool and the supply of water is convenient.

Furthermore, in the laundry treatment apparatus of the present invention, the bottom end of the water supply unit is formed lower than the top surface of the condensing pool. Therefore, the present invention is advantageous in that steam is not brought in contact with water and can be prevented from flowing backward through the bottom end of the water supply unit.

Furthermore, in the laundry treatment apparatus of the present invention, the bottom end of the water supply unit is isolated from the bottom surface of the condensing pool, and the bottom end of the water supply unit is not stopped by the bottom surface of the condensing pool accordingly. Therefore, the present invention is advantageous in that water can be supplied easily and rapidly.

Furthermore, in the method of controlling the laundry treatment apparatus according to the present invention, if a water temperature within the tub is higher than a set temperature at which steam is generated within the tub, water is supplied to the steam reverse flow-preventing unit installed on the water supply channel. The water supplied to the steam reverse flow-preventing unit precludes the reverse flow of the steam. Therefore, the present invention is advantageous in that it can minimize the reverse flow of steam and can prevent the contamination of the detergent holder, and the like.

Furthermore, in the method of controlling the laundry treatment apparatus according to the present invention, the supply of water to the steam reverse flow-preventing unit is repeated at predetermined time intervals. Therefore, although the water supplied to the steam reverse flow-preventing unit is overflowed because of vibration, etc., new water can be supplied continuously. Accordingly, the present invention is advantageous in that it can preclude the reverse flow of steam consistently at the time of hot-water washing.

Furthermore, in the method of controlling the laundry treatment apparatus according to the present invention, the water supply valve is opened for a set time, which is proportional to the capacity of the condensing pool of the steam reverse flow-preventing unit. Therefore, the present invention is advantageous in that it can prevent the excess or shortage of water supplied to the condensing pool.

Furthermore, in the method of controlling the laundry treatment apparatus according to the present invention, if the dry cycle is input, water for condensing steam is supplied to the steam reverse flow-preventing unit installed on the water supply channel. Therefore, the present invention is advantageous in that it can prevent the reverse flow of steam, which has occurred during the dry cycle, although the water of the steam reverse flow-preventing unit is overflowed during the dehydration cycle anterior to the dry cycle.

Furthermore, in the method of controlling the laundry treatment apparatus according to the present invention, since water supplied while sensing an amount of fabrics can be overflowed, the water is supplied to the steam reverse flow-preventing unit after the sensing of the amount of fabrics. Therefore, the present invention is advantageous in that it can minimize an amount of water supplied and the number of water supplied.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A laundry treatment apparatus, comprising:

a water supply port formed at a tub that supplies water into a drum;

a water supply bellows configured to connect a detergent box to the water supply port;

a condensing pool disposed within the water supply port, a water supply passage being formed between the condensing pool and the water supply port; and a cap disposed at an upper portion of the water supply port that guides water supplied from the water supply, bellows into the condensing pool and prevents steam flowing backward through the water supply passage from being introduced into the water supply bellows; wherein the cap comprises: a shielding device disposed on an upper side of the water supply passage that stops rise of the steam; and a hollow water supply device integrally formed with the shielding device such that the hollow water supply device projects toward an inside of the condensing pool.

2. The laundry treatment apparatus as set forth in claim 1, wherein the condensing pool comprises an open top surface so that the supplied water overflows to the water supply passage.

3. The laundry treatment apparatus as set forth in claim 1, wherein the condensing pool has a circumferential portion isolated from an inner wall of the water supply port such that a water supply passage is formed between the circumferential portion and the inner wall of the water supply port.

4. The laundry treatment apparatus as set forth in claim 1, further comprising at least one rib that connects a circumferential portion of the condensing pool and an inner wall of the water supply port between the circumferential portion of the condensing pool and the it wall of the water supply port.

5. The laundry treatment apparatus as set forth in claim 1, wherein the condensing pool has a bottom surface formed on the same concentric cycle as the tub.

6. The laundry treatment apparatus as set forth in claim 1, wherein the shielding device has an outer diameter configured to fit into an inner wall of the water supply port when the shielding device is inserted into the water supply port and is mounted therein.

7. The laundry treatment apparatus as set forth in claim 1, wherein the water supply device has a tapered diameter.

8. The laundry treatment apparatus as set forth in claim 1, wherein the water supply device has a bottom end that is lower than a top surface of the condensing pool.

9. The laundry treatment apparatus as set forth in claim 1, wherein the water supply device has a bottom end having a height isolated from a bottom surface of the condensing pool.

10. The laundry treatment apparatus as set forth in claim 1, further comprising a dry device coupled to the tub that dries a fabric within the drum.

11. The laundry treatment apparatus as set forth in claim 1, wherein the water supply port and the condensing pool are integrally formed with the tub.

12. The laundry treatment apparatus as set forth in claim 1, wherein the shielding device has an opening at a central portion thereof through which water supplied from the water supply bellows is guided into the water supply device.

* * * * *